US006527352B2

(12) United States Patent
Lombardo

(10) Patent No.: US 6,527,352 B2
(45) Date of Patent: Mar. 4, 2003

(54) STORAGE ELEMENT

(76) Inventor: Anthony Lombardo, 11 Sheperds La., P.O. Box 1634, Amagansett, NY (US) 11930

( * ) Notice: Subject to any disclaimer, the term of this patent is extended or adjusted under 35 U.S.C. 154(b) by 0 days.

(21) Appl. No.: 09/791,364

(22) Filed: Feb. 23, 2001

(65) Prior Publication Data

US 2002/0117946 A1 Aug. 29, 2002

(51) Int. Cl.[7] ..... A47B 88/00
(52) U.S. Cl. ..... 312/322
(58) Field of Search ..... 312/322, 324, 312/331; 49/254

(56) References Cited

U.S. PATENT DOCUMENTS 3,339,995 A * 9/1967 Bencene ..... 312/322
4,350,399 A 9/1982 Berton et al.
4,574,524 A 3/1986 Bonetti et al.
4,803,749 A 2/1989 Rock et al.
4,852,212 A 8/1989 Amann
4,903,433 A * 2/1990 Baus
5,108,165 A * 4/1992 Rorke et al. ..... 312/322
5,121,976 A 6/1992 Haab et al.
5,149,180 A 9/1992 Haab et al.

FOREIGN PATENT DOCUMENTS

DE 155056 * of 1904 ..... 312/322

* cited by examiner

*Primary Examiner*—Janet M. Wilkens
(74) *Attorney, Agent, or Firm*—Richard L. Miller

(57) ABSTRACT

A storage element that includes a pair of side walls, a front header panel, a pair of doors, and apparatus that selectively conceals the pair of doors. Each door has an uppermost edge with a high point that is intermediate thereof. The front header panel has a pair of throughslots that provide clearance for the high points of the pair of doors when the pair of doors are slid therethrough and concealed. The apparatus includes a pair of blocks that fill the pair of throughslot in the front header panel when the pair of doors are closed so as to provide a clean look for the front header panel when the pair of doors are closed. The pair of blocks either move with the pair of doors or are hingedly attached to the front header panel and are responsive to movement of the pair of doors.

13 Claims, 2 Drawing Sheets

STORAGE ELEMENT

BACKGROUND OF THE INVENTION

1. Field of the Invention

The present invention relates to an element. More particularly, the present invention relates to a storage element.

2. Description of the Prior Art

Numerous innovations for door related devices have been provided in the prior art that will be described. Even though these innovations may be suitable for the specific individual purposes to which they address, however, they differ from the present invention.

A FIRST EXAMPLE, U.S. Pat. No. 4,350,399 to Berton et al. teaches a door of furniture formed by a series of uniformly sized panels which are movable from a closed position, in which they are coplanar one with another, to an open position, in which they are parallel and folded on one side of the furniture itself. The panels are connected together by means of a parallelogram linkage system which allows the panels to be moved from the closed position to the open position by means of a single control. The panels slide in an upper guide and a lower guide of the furniture and fold onto the left hand side of the furniture, allowing full access to the furniture itself. The parallelogram system comprise two sets of rods which are substantially identical and arranged between an upper side of the panels and the upper guide of the furniture and between a lower side of the panels and the lower guide, respectively.

A SECOND EXAMPLE, U.S. Pat. No. 4,571,524 to Bonetti et al. teaches apparatus for opening aligned sliding leaves of furniture, wherein each sliding leaf comprises, at its upper part, an upper track for receiving a first roller having a vertical axis and connected to a movable part of a slide guide fixedly secured to or integral with the furniture. The movable part is movable in a direction substantially perpendicular to the plane of the leaf and is provided with an engagement member, such as a pin, coupled with a first pulley connected, by means of an inextensible, flexible element, to a second pulley in a lower part of the furniture. The second pulley is supported by a horizontal shaft extending across the width of the door leaf and is provided at its ends with a pair of arms, acting upon lateral trolleys supported by pairs of rollers sliding in guides rigidly secured to the furniture. The trolleys carry a U-section member in which run horizontal-axis second rollers and vertical-axis third rollers, rigidly connected to the door leaf by means of a lower support member. On the lower member are also mounted fourth rollers arranged, when the leaf is moved perpendicular to the plane and in a direction away from the furniture, to cooperate with a horizontal lower track mounted parallel to the front surface of the furniture.

A THIRD EXAMPLE, U.S. Pat. No. 4,803,749 to Rock et al. teaches a hinge mounting plate suitable for fastening to a furniture frame that is U-shaped and is laterally slidable onto the furniture frame. A distance compensating plate is provided at one of the two parallel side flanges of the mounting plate.

A FOURTH EXAMPLE, U.S. Pat. No. 4,852,212 to Amann teaches a set of hardware for mounting a hinged and slidable door on a box unit of furniture that comprises hardware elements which define a pivotal axis for mounting the door and comprise slide track devices which are adapted to be mounted to extend parallel to the pivotal axis and to a wall of the box and to guide the door into the box when the door has been swung open. To permit a substantial use of commercially available, simple components and a simple adaption of the hardware elements to doors differing in size, the slide track devices comprise two track rails, which are adapted to be mounted so as to be spaced apart and to extend horizontally. A trolley is associated with each of the rack rails and comprises rollers guided on bearing surfaces of the guide rails. The trolleys are adapted to be interconnected by a mounting plate on that side of the rails which faces away from the wall of the box. The door is hinged to the mounting plate by furniture hinges. Carriage stop devices are provided for limiting the movement of the carriages along the rails. Adjustable door stop devices are provided for cooperation with the door in its closed position at those edges of the door which extend from the edge at which the furniture hinges are provided.

A FIFTH EXAMPLE, U.S. Pat. No. 5,121,976 to Haab et al. teaches a door for a furniture article which is lowerable into a door compartment that is fastened to a door-carrying bar which is fixed to a scissors-assembly having two beams anchored on one side wall of the door compartment. To facilitate the adjustment of the scissors-assembly, an upper anchor assembly of one of the beams of the scissors-assembly is located on a fixing member, which is connected via the one side wall to an adjusting member so that, on pivoting the adjusting member about a screw, the fixing member is also moved. The door-carrying bar is guided on two opposite rails, which are screwed to bushes which are in turn screwed into the one side wall for adjusting the spacing between the wall and a respective rail. For maintaining the spacing between the door and a second wall, facing the first side wall, the door-carrying bar carries a roller which presses against a plastic plate provided in the vicinity of the leading edge of the first side wall when the door is not lowered. A set screw is provided in the door to permit a vertical displacement of the door-carrying the bar with respect to the scissors-assembly.

A SIXTH EXAMPLE, U.S. Pat. No. 5,149,180 to Haab et al. teaches a door for an article of furniture which is slidable into a door compartment is fastened to a door-carrying bar which in turn is connected to a scissors-assembly having two beams anchored on one side wall of the door compartment. The door-carrying bar is guided on an upper rail fixed to one of two side walls of a door compartment and on a lower rail also disposed in the door compartment. In order to permit a precise fitting of the door and to facilitate an adjustment of the door, the lower rail is also fixed to the one of two side walls. Both rails are connected to the one side wall by bushings screwed into the rails and permitting an adjustment of a spacing of the rail from the side wall. The door-carrying bar has a roller which, when the door is not lowered, presses against a plastic plate provided in the vicinity of the leading edge of the one side wall. A set screw is provided to permit a vertical displacement of the bar with respect to the scissors-assembly.

It is apparent that numerous innovations for door related devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a storage element that avoids the disadvantages of the prior art.

ANOTHER OBJECT of the present invention is to provide a storage element that is simple and inexpensive to manufacture.

STILL ANOTHER OBJECT of the present invention is to provide a storage element that is simple to use.

BRIEFLY STATED, STILL YET ANOTHER OBJECT of the present invention is to provide a storage element that includes a pair of mu side walls, a front header panel, a pair of doors, and apparatus that selectively conceals the pair of doors. Each door has an uppermost edge with a high point that is intermediate thereof. The front header panel has a pair of throughslots that provide clearance for the high points of the pair of doors when the pair of doors are slid therethrough and concealed The apparatus includes a pair of blocks that fill the pair of throughslots in the front header panel when the pair of doors are closed so as to provide a clean look for the front header panel when the pair of doors are closed. The pair of blocks either move with the pair of doors or are hingedly attached to the front header panel and are responsive to movement of the pair of doors.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

First Embodiment

Figure 1:
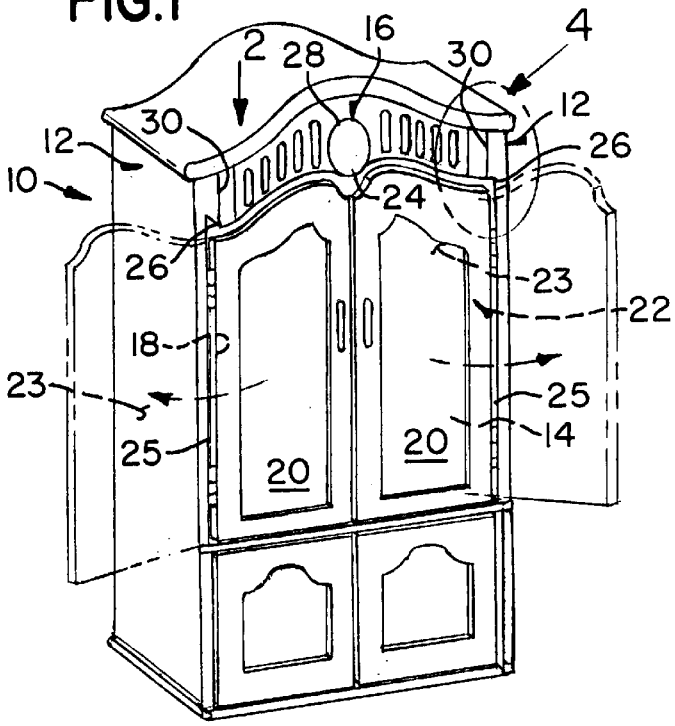
FIG. 1 is a diagrammatic perspective view of the present invention with the doors closed.
Figure 4:
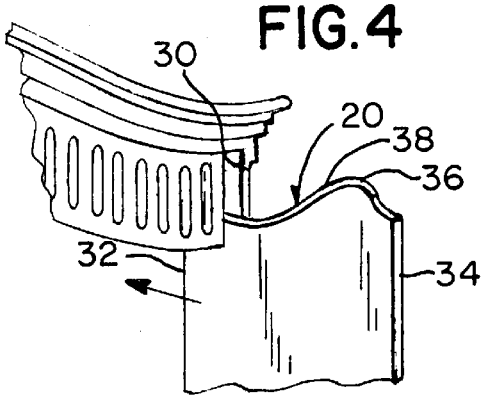
FIG. 4 is a diagrammatic perspective view of the area generally enclosed by the dotted curve identified by arrow 4 in FIG. 1 of the door of the present invention shown in FIG. 3 in the process of being concealed.
Figure 3:
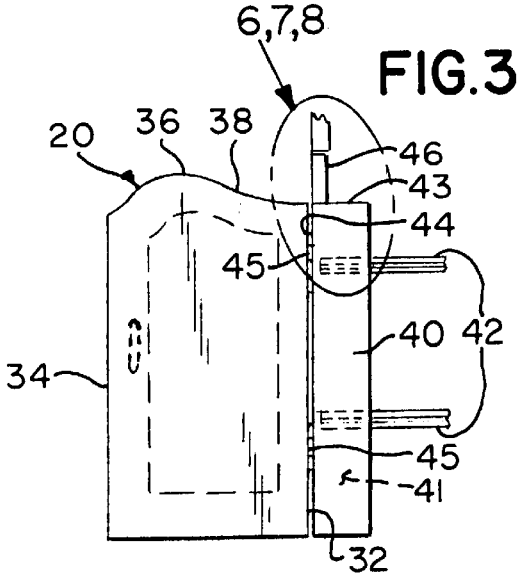
FIG. 3 is a diagrammatic elevational view of the door of the present invention shown in FIG. 2 extended and ready for concealing.
Figure 2:
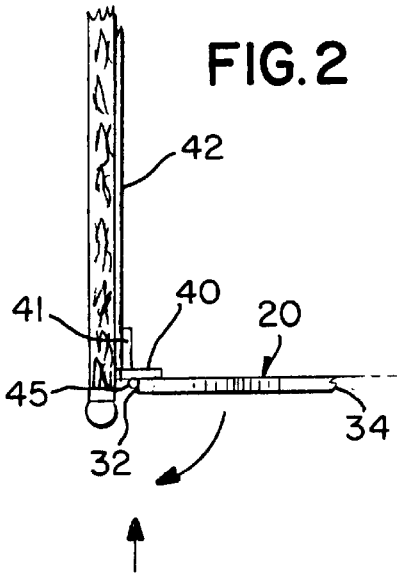
FIG. 2 is an enlarged diagrammatic top plan view taken generally in the direction of arrow 2 in FIG. 1 of a door of the present invention closed.
Figure 5:
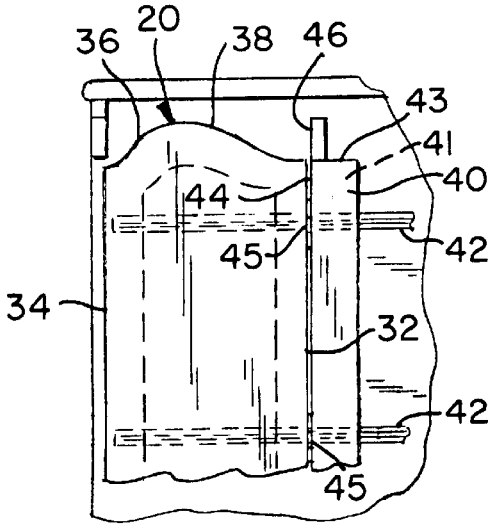
FIG. 5 is a diagrammatic elevational view of the door of the present invention shown in FIG. 4 fully concealed.
Figure 6:
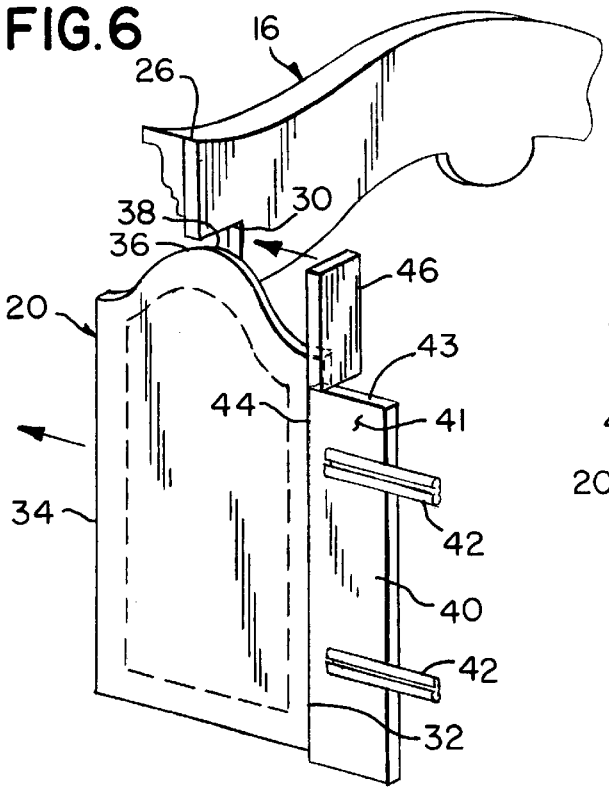
FIG. 6 is a enlarged diagrammatic perspective view of the area generally enclosed by the dotted curve identified by arrow 6 in FIG. 3, but only partially extended, of a first embodiment of the block of the present invention.
Figure 7:
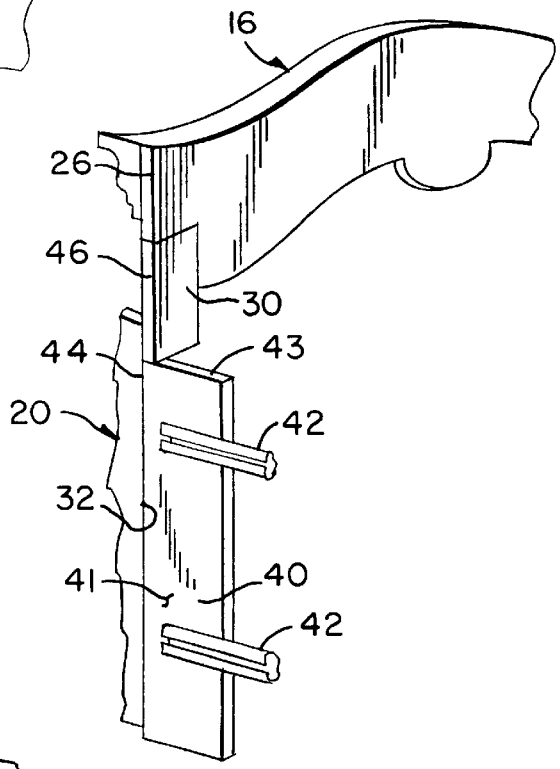
FIG. 7 is an enlarged diagrammatic perspective view of the area generally enclosed by the dotted curve identified by arrow 7 in FIG. 3.

10 storage element of present invention
12 pair of side walls
14 first space defined between pair of side walls 12
16 front header panel
18 second space defined by pair of side walls 12 and front header panel 16
20 pair of doors
22 apparatus
23 innermost surface of each side wall of pair of side walls 12
24 lowermost edge of front header panel 16
25 forwardmost vertical edge of each side wall of pair of side walls 12
26 pair of terminal ends of lowermost edge 24 of front header panel 16
28 intermediate portion of lowermost edge 24 of front header panel 16
30 throughslot in each terminal end of pair of terminal ends 26 of lowermost edge 24 of front header panel 16
32 outermost vertical edge of each door of pair of doors 20
34 innermost vertical edge of each door of pair of doors 20
36 uppermost edge of each door of pair of doors 20
38 portion of uppermost edge 36 of each door of pair of doors 20
40 pair of plates of apparatus 22
41 innermost surface of each plate of pair of plates 40 of apparatus 22
42 two pair of tracks of apparatus 22
43 uppermost edge of each plate of pair of plates 40 of apparatus 22
44 forwardmost vertical edge of each plate of pair of plates 40 of apparatus 20
45 at least one hinge of apparatus 22
46 pair of blocks of apparatus 22

Second Embodiment

110 storage element of present invention
116 front header panel
118 second space
120 pair of doors
124 lowermost edge of front header panel 116
126 pair of terminal ends of lowermost edge 124 of front header panel 116
130 throughslot in each terminal end of pair of terminal ends 126 of lowermost edge 124 of front header panel 116
146 pair of blocks
147 innermost surface of front header panel 116
148 hinge of each block of pair of blocks 146
150 high point of each door of pair of doors 120

DETAILED DESCRIPTION OF THE PREFERRED EMBODIMENT

Referring now to the figures, in which like numerals indicate like parts, and particularly to FIG. 1, the storage element of the present invention is shown generally at 10.

The overall configuration of the storage element 10 can best be seen in FIG. 1, and as such, will be discussed with reference thereto.

The storage element 10 comprises a pair of side walls 12 that define a first space 14 therebetween.

The storage element 10 further comprises a front header panel 16 that extends across the pair of side walls 12, and defines therewith, a second space 18.

The storage element 10 further comprises a pair of doors 20 that are operatively attached to the pair of side walls 12, below the front header panel 16, and selectively close the second space 18.

The storage element 10 further comprises apparatus 22 that is associated with the pair of side walls 12 and the pair of doors 20, and allows the pair of doors 20 to be selectively concealed in the first space 14.

Each side wall 12 has an innermost surface 23 that face each other and a forwardmost vertical edge 25.

The front header panel 16 has a lowermost edge 24 with a pair of terminal ends 26, and an intermediate portion 28 that extends intermediate the pair of terminal ends 26 of the lowermost edge 24 of the front header panel 16.

The intermediate portion 28 of the lowermost edge 24 of the front header panel 16 is at an elevation that is higher than that of the pair of terminal ends 26 of the lowermost edge 24 of the front header panel 16.

Each terminal end 26 of the lowermost edge 24 of the front header panel 16 has a throughslot 30 that extends vertically upwardly therefrom, and is bounded by the front vertical edge 25 of an associated side wall 12.

The specific configuration of the pair of doors 20 and the apparatus 22 can best be seen in FIGS. 2–7, and as such, will be discussed with reference thereto.

Each door 20 has an outermost vertical edge 32 that is operatively connected to an associated side wall 12, an innermost vertical edge 34 that face each other when the pair of doors 20 are closed, and an uppermost edge 36 that has a portion 38 that is at an elevation that is higher than that of the outermost vertical edge 32 thereof so as to form a convex uppermost edge.

The apparatus 22 comprises a pair of plates 40.

Each plate 40 has an innermost surface 41, an uppermost edge 43, and a forwardmost vertical edge 44 that extends vertical along, and is pivotally mounted to, the outermost vertical edge 32 of an associated door 20 by at least one hinge 45 so as to allow the associated door 20 to pivot relative thereto.

The apparatus 22 further comprises two pair of tracks 42.

Each pair of tracks 42 are horizontally-oriented, vertically spaced-apart, and have a portion thereof extending along the innermost surface 41 of an associated plate 40, and a mating portion thereof, extending along the innermost surface 23 of an associated side wall 16 so as to allow the associated plate 40 to slide relative to the associated side wall 16, with an associated door 20 pivotally attached to the associated plate 40 so as to allow the pair of doors 20 to slid into, and be concealed by, the first space 14 by virtue of the two pair of tracks 42 when the pair of doors 20 are opened by pivoting relative to the pair of plates 40, and with the throughslot 30 in each terminal end 26 of the lowermost edge 24 of the front header panel 16 providing clearance for the convex uppermost edge of each door 20.

The apparatus 22 further comprises a pair of blocks 46.

Each block 46 fills the throughslot 30 in an associated terminal end 26 of the lowermost edge 24 of the front header panel 16 when an associated door 20 closes an associated portion of the second space 18 so as to provide a clean look for the front header panel 16 when the pair of doors 20 are closed.

Each block 46 extends vertically upwardly and transversely inwardly from, and moves with, the uppermost edge 43 of an associated plate 40, at the forwardmost vertical edge 44 of the associated plate 40.

Figure 8:
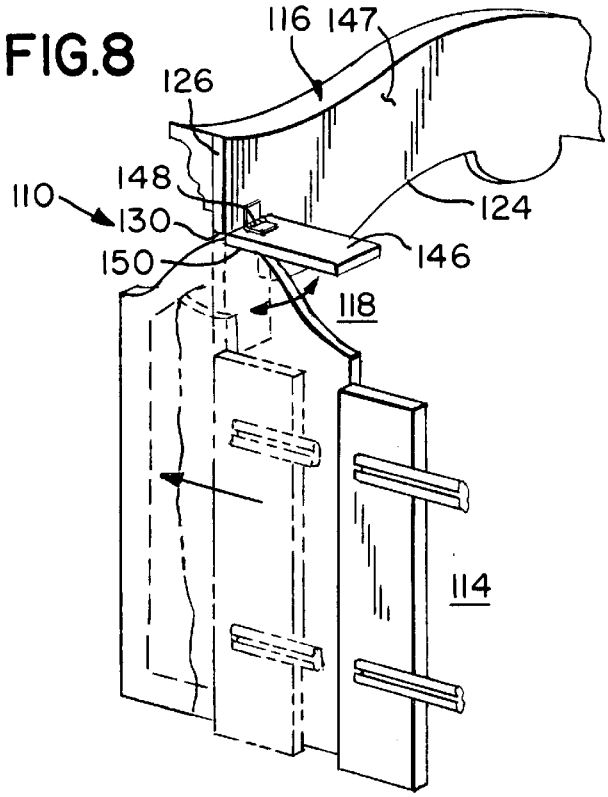
FIG. 8 is an enlarged diagrammatic perspective view of the area generally enclosed by the dotted curve identified by arrow 8 in FIG. 3, but only partially extended, of a second embodiment of the block of the present invention.

The configuration of a second embodiment of the storage element 110 can best be seen in FIG. 8, and as such, will be discussed with reference thereto.

The storage element 110 is similar to the storage element 107 except that:

1) The front header panel 116 has an innermost surface 147.
2) The convex uppermost edge of each door 120 has a high point 150.
2) Each block 146 is hingedly attached, by a hinge 148, to, and selectively pivots downwardly from, the innermost surface 147 of the front header panel 116, directly above the throughslot 130 in an associated terminal end 126 of the lowermost edge 124 of the front header panel 116, and when pivoted downwardly, closes the throughslot 130 in an associated terminal end 126 of the lowermost edge 124 of the front header panel 116 when an associated door 120 is closed and closes an associated portion of the second space 118, but has a length that is long enough to prevent passing the high point 150 of the convex uppermost edge of an associated door 120 when the associated door 120 is concealed in the first space 114 so as to prevent jamming when the associated door 120 is pulled out.

It will be understood that each of the elements described above, or two or more together, may also find a useful application in other types of constructions differing from the types described above.

While the invention has been illustrated and described as embodied in a storage element, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A storage element, comprising:

a) a pair of side walls defining a first space therebetween;

b) a front header panel extending across said pair of side walls, and therewith defining, a second space;

c) a pair of doors operatively attached to said pair of side walls, below said front header panel, and selectively closing said second space; and d) apparatus associated with said pair of side walls and said pair of doors and allowing said pair of doors to be selectively concealed in said first space, wherein each side wall has:

A) an innermost surface; and

B) a forwardmost vertical edge, wherein said front header panel has a lowermost edge with:

i) a pair of terminal ends; and ii) an intermediate portion that extends intermediate said pair of terminal ends of said lowermost edge of said front header panel, wherein said intermediate portion of said lowermost edge of said front header panel is at an elevation that is higher than that of said pair of terminal ends of said lowermost edge of said front header panel.

2. The element as defined in claim 1, wherein each terminal end of said lowermost edge of said front header panel has a throughslot that extends vertically upwardly therefrom, and is bounded by a front vertical edge of an associated side wall.

3. The element as defined in claim 2, wherein each door has:

a) an outermost vertical edge that is operatively connected to an associated side wall;

b) an innermost vertical edge; and c) an uppermost edge that has a portion that is at an elevation that is higher than that of said outermost vertical edge thereof so as to form a convex uppermost edge.

4. The element as defined in claim 3, wherein said apparatus comprises a pair of plates.

5. The element as defined in claim 4, wherein each plate extends vertical along, and is pivotally mounted to, said outermost vertical edge of an associated door so as to allow said associated door to pivot relative thereto, and has:

a) an innermost surface; and b) an uppermost edge.

6. The element as defined in claim 5, wherein said apparatus further comprises two pair of tracks.

7. The element as defined in claim 6, wherein each pair of tracks are horizontally-oriented and have a portion thereof extending along said innermost surface of an associated plate, and a mating portion thereof extending along said innermost surface of an associated side wall so as to allow said associated plate to slide relative to said associated side wall, with said associated door pivotally attached to said associated plate so as to allow said pair of doors to slid into, and be concealed by, said first space by virtue of said two pair of tracks when said pair of doors are opened by pivoting relative to said pair of plates, and with said throughslot in each terminal end of said lowermost edge of said front header panel providing clearance for said convex uppermost edge of each door.

8. The element as defined in claim 7, wherein said apparatus further comprises a pair of blocks.

9. The element as defined in claim 8, wherein each block fills said throughslot in an associated terminal end of said lowermost edge of said front header panel when an associated door closes an associated portion of said second space so as to provide a clean look for said front header panel when said a pair of doors are closed.

10. The element as defined in claim 8, wherein each block extends vertically upwardly and transversely inwardly from, and moves with, said uppermost edge of an associated plate, at said forwardmost vertical edge of said associated plate.

11. The element as defined in claim 8, wherein said front header panel has an innermost surface.

12. The element as defined in claim 3, wherein said convex uppermost edge of each door has a high point.

13. The element as defined in claim 12, wherein a block is hingedly attached, by a hinge, to, and selectively pivots downwardly from, an innermost surface of said front header panel, directly above said throughslot in an associated terminal end of said lowermost edge of said front header panel, and when pivoted downwardly, closes said throughslot in an associated terminal end of said lowermost edge of said front header panel when an associated door is closed and closes an associated portion of said second space, but has a length that is long enough to prevent passing said high point of said convex uppermost edge of an associated door when said associated door is concealed in said first space so as to prevent jamming when said associated door is pulled out.

* * * * *